US008720663B2

(12) United States Patent
Chiang et al.

(10) Patent No.: US 8,720,663 B2
(45) Date of Patent: May 13, 2014

(54) BILL JAM TROUBLESHOOTING

(71) Applicant: International Currency Technologies Corporation, Taipei (TW)

(72) Inventors: Yung-Hao Chiang, Taipei (TW); Cheng-Yi Wu, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 13/648,990

(22) Filed: Oct. 10, 2012

(65) Prior Publication Data

US 2014/0097063 A1 Apr. 10, 2014

(51) Int. Cl.
*G07F 7/04* (2006.01)
*G07F 9/02* (2006.01)

(52) U.S. Cl.
USPC ..... 194/206; 194/200

(58) Field of Classification Search
USPC ..... 194/200, 206; 235/379; 209/379; 271/3.13, 3.15, 225
See application file for complete search history.

(56) References Cited

U.S. PATENT DOCUMENTS 4,749,076 A * 6/1988 Akagawa et al. ..... 194/207

* cited by examiner

*Primary Examiner* — Mark Beauchaine
(74) *Attorney, Agent, or Firm* — Muncy, Geissler, Olds & Lowe, P.C.

(57) ABSTRACT

A bill jam troubleshooting employed in a bill acceptor used in a consumer system includes the step of displaying an error message when a fake bill is identified by a sampling and validation module, the step of driving the transmission mechanism to carry the inserted bill back and forth over a validation zone repeatedly twice when a bill jam is detected, and the step of controlling the transmission mechanism to return the inserted bill to the bill slot. Thus, the invention improves the function and effect on the overall use of the product, and enhances the advantages and opportunities of commodity sales channels to increase product competitiveness.

2 Claims, 9 Drawing Sheets

BILL JAM TROUBLESHOOTING

BACKGROUND OF THE INVENTION

1. Field of the Invention

The present invention relates to bill acceptor technology and more particularly, to a bill jam troubleshooting employed in a bill acceptor for troubleshooting a bill jam during return of an inserted counterfeit bill by carrying the jammed bill back and forth repeatedly and then returning the bill to the bill slot to clear the bill jam problem. Thus, the invention improves the function and effect on the overall use of the product, and enhances the advantages and opportunities of commodity sales channels to increase product competitiveness.

2. Description of the Related Art

Following fast development of technology, the distance among people has been greatly shortened, our mode of living has been changed, and different automatic vending machines, automatic teller machines and bill acceptors are used in many public places to sell different products or to provide different consumer services without serviceman. These automatic vending machines, automatic teller machines and bill acceptors are highly invited for the advantage of saving much labor and bringing convenience to people. Further, advanced automatic vending machines provide added functions.

Many counterfeit bills made by evil individuals are circulating in the market. To avoid receiving counterfeit bills, a bill acceptor generally provides a bill validator for validating the authenticity and value of an inserted before receiving the bill. Regular bill acceptors are commonly designed for receiving bills of a predetermined width. The inserted bill must be kept in accurate alignment with the validator so that the validator can accurately validate the authenticity and value of the bill.

Further, if a bill is obliquely inserted into the bill slot of a bill acceptor, the inserted bill may wrinkle. A wrinkled bill may be jammed easily in the bill passage of a bill acceptor. When a bill jam occurs, the jammed bill must be discharged. Further, if a jammed bill is a counterfeit bill, the transmission mechanism of the bill acceptor may be unable to return the jammed counterfeit bill to the bill slot due to material and/or dimensional differences. If a bill jam problem cannot be cleared automatically by the bill acceptor, the provider must send a person to the site of the bill acceptor to troubleshoot the bill jam or to repair the machine, interrupting the use of the machine for a certain length of time. This troubleshooting costs a lot. Further, interruption of the use of the machine can lead to loss of money.

SUMMARY OF THE INVENTION

The present invention has been accomplished under the circumstances in view. It is therefore one object of the present invention to provide a bill jam troubleshooting for use in a bill acceptor of a consumer system, which automatically troubleshoots a bill jam, improving the function and effect on the overall use of the product, and enhancing the advantages and opportunities of commodity sales channels to increase product competitiveness.

To achieve this and other objects of the present invention, a bill jam troubleshooting is employed in a bill acceptor used in a consumer system. After initialization of the system, the bill validation device of the bill-receiving unit of the bill acceptor validates the authenticity of the inserted bill, and the transmission mechanism of the bill-receiving unit presses the inserted bill to start receiving the bill. If the inserted bill is jammed in the bill passage, the transmission mechanism starts troubleshooting to clear the jammed bill. At this time, the transmission mechanism is controlled to carry the jammed bill back and forth over the validation zone repeatedly twice, and then controlled to return the bill to the bill slot on the front face panel of the main unit of the bill acceptor.

DETAILED DESCRIPTION OF THE PREFERRED EMBODIMENT

Figure 1:
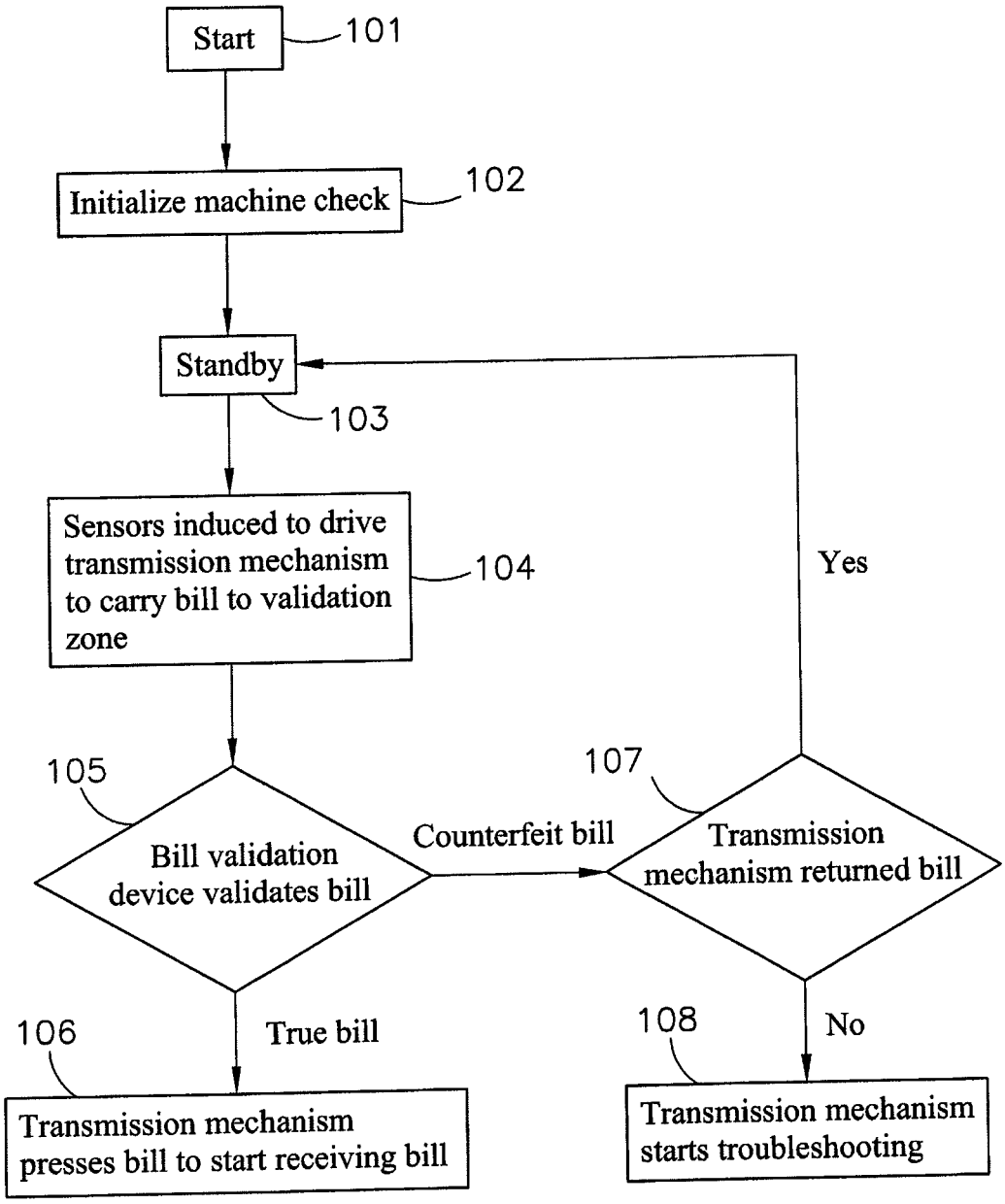
FIG. 1 is a bill-receiving operational flow chart of a bill acceptor employing a bill jam troubleshooting in accordance with the present invention.
Figure 2:
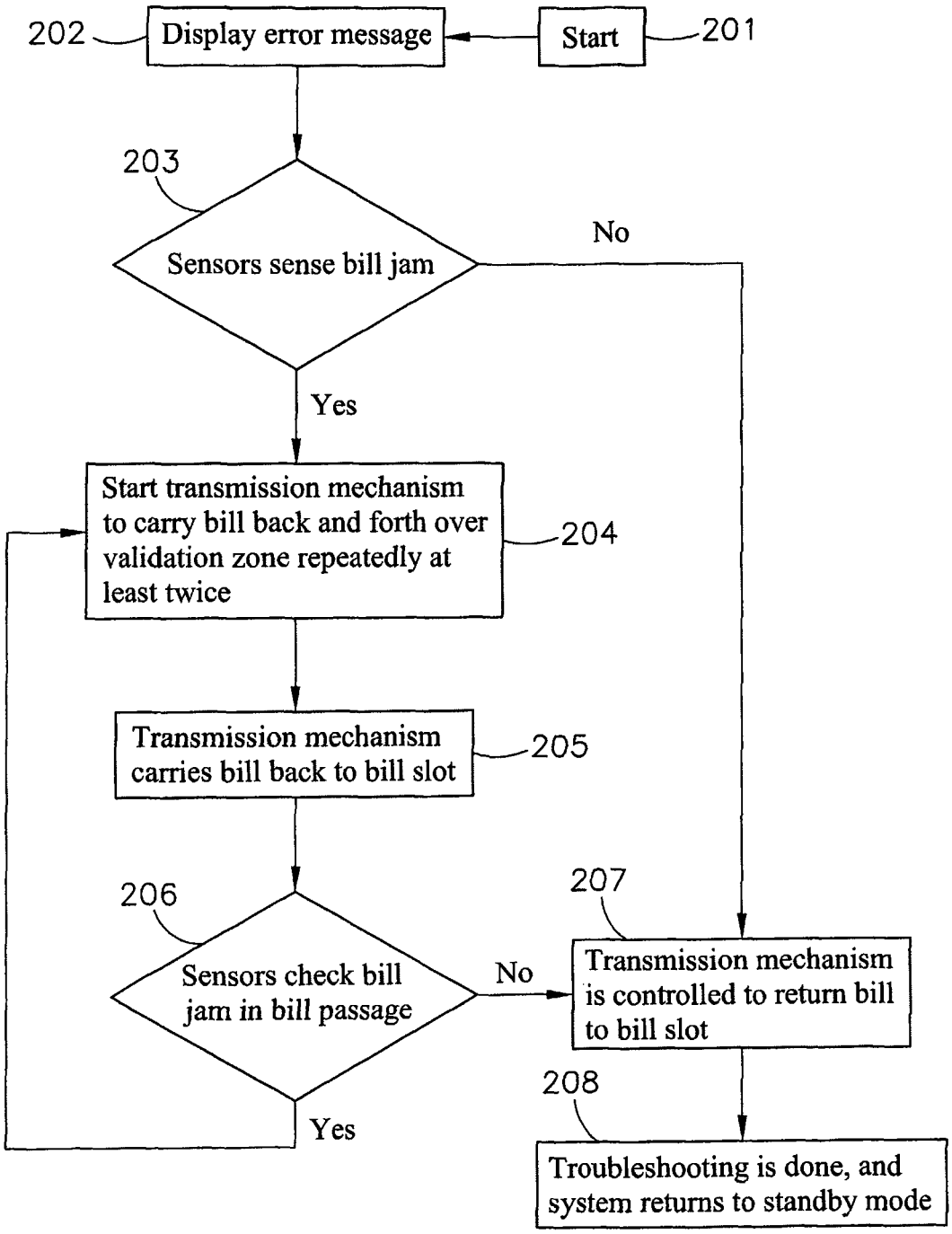
FIG. 2 is a bill jam troubleshooting flow chart in accordance with the present invention.
Figure 3:
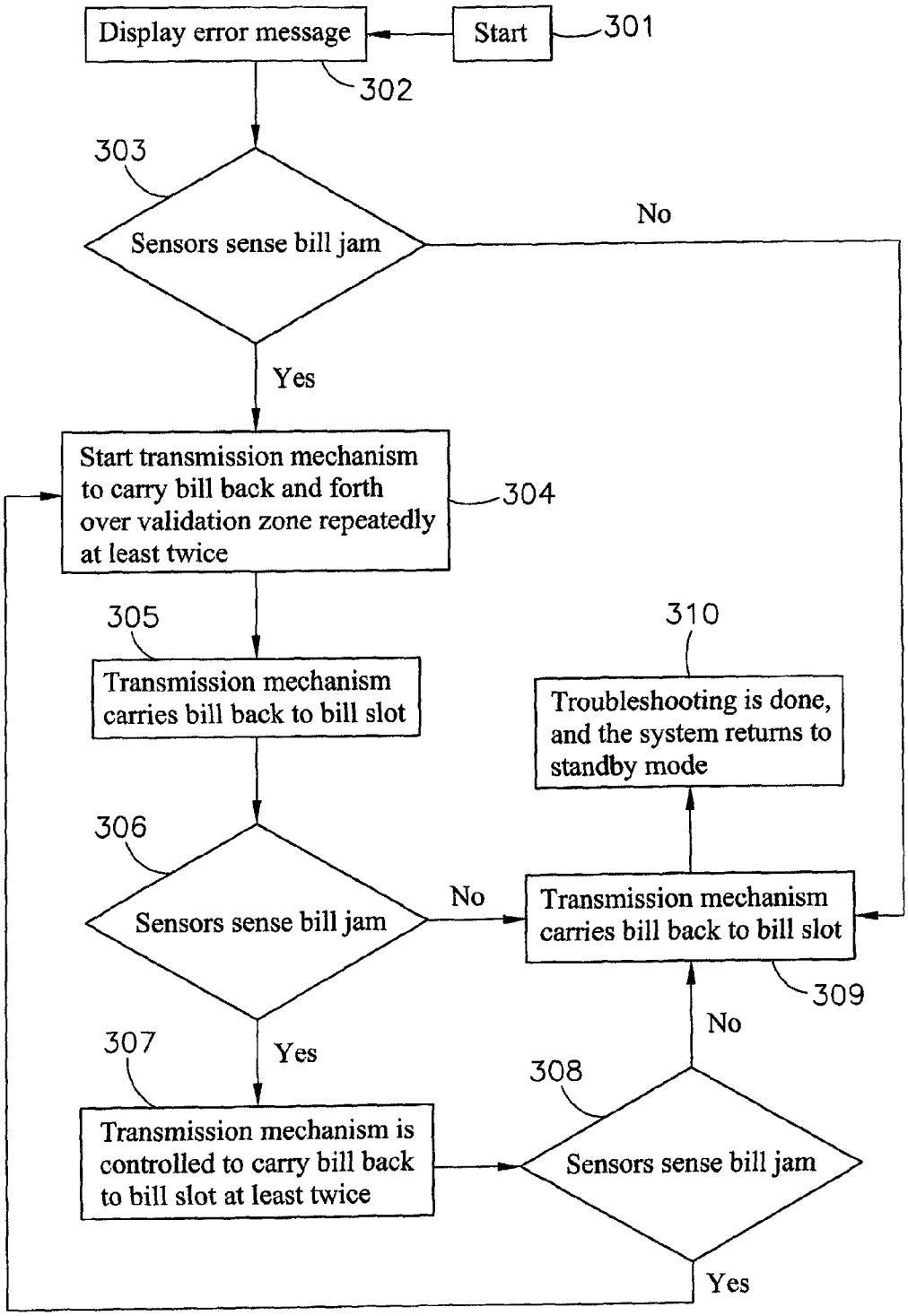
FIG. 3 is a bill jam troubleshooting flow chart in accordance with an alternate form of the present invention.
Figure 4:
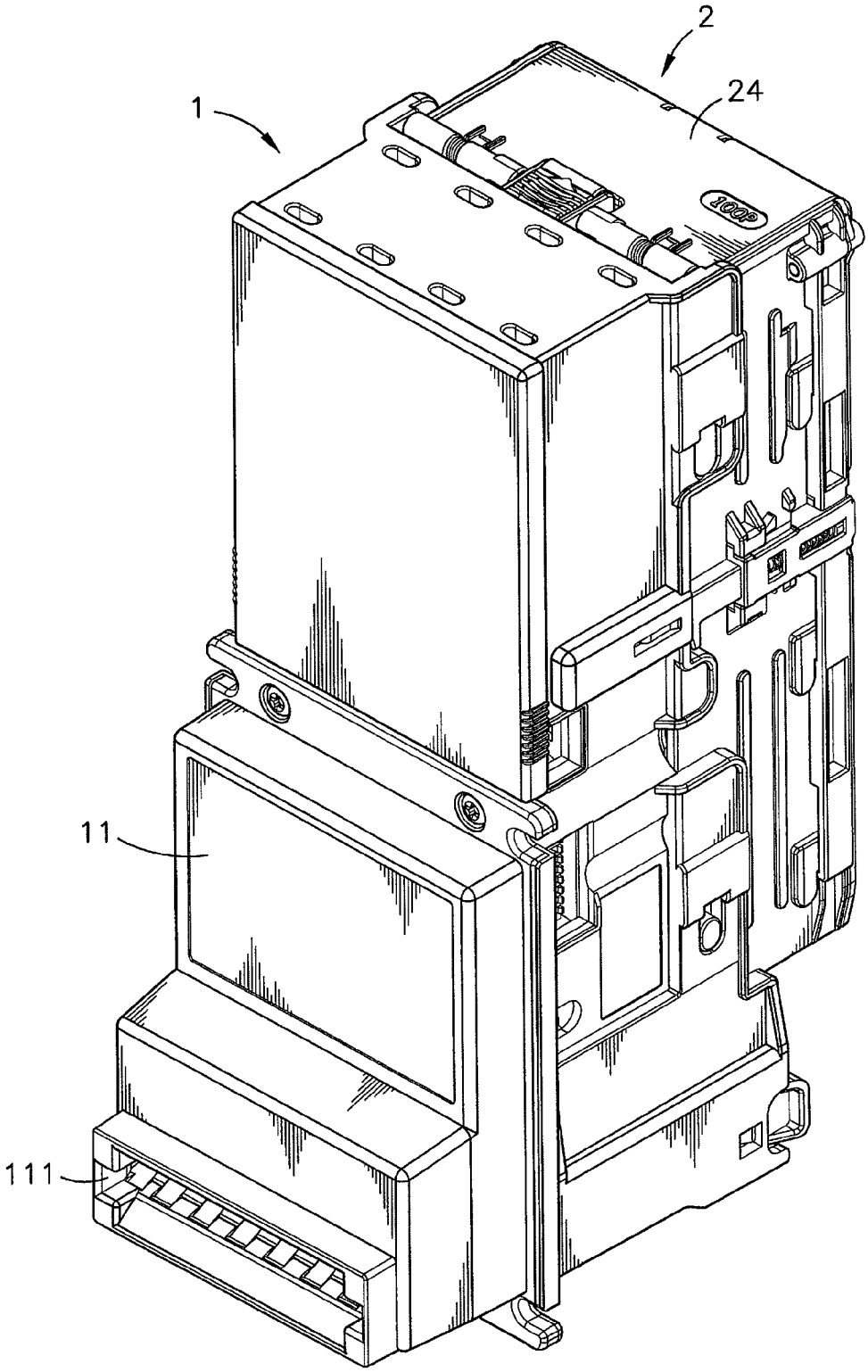
FIG. 4 is an elevational view of the bill acceptor employing the bill jam troubleshooting in accordance with the present invention.
Figure 5:
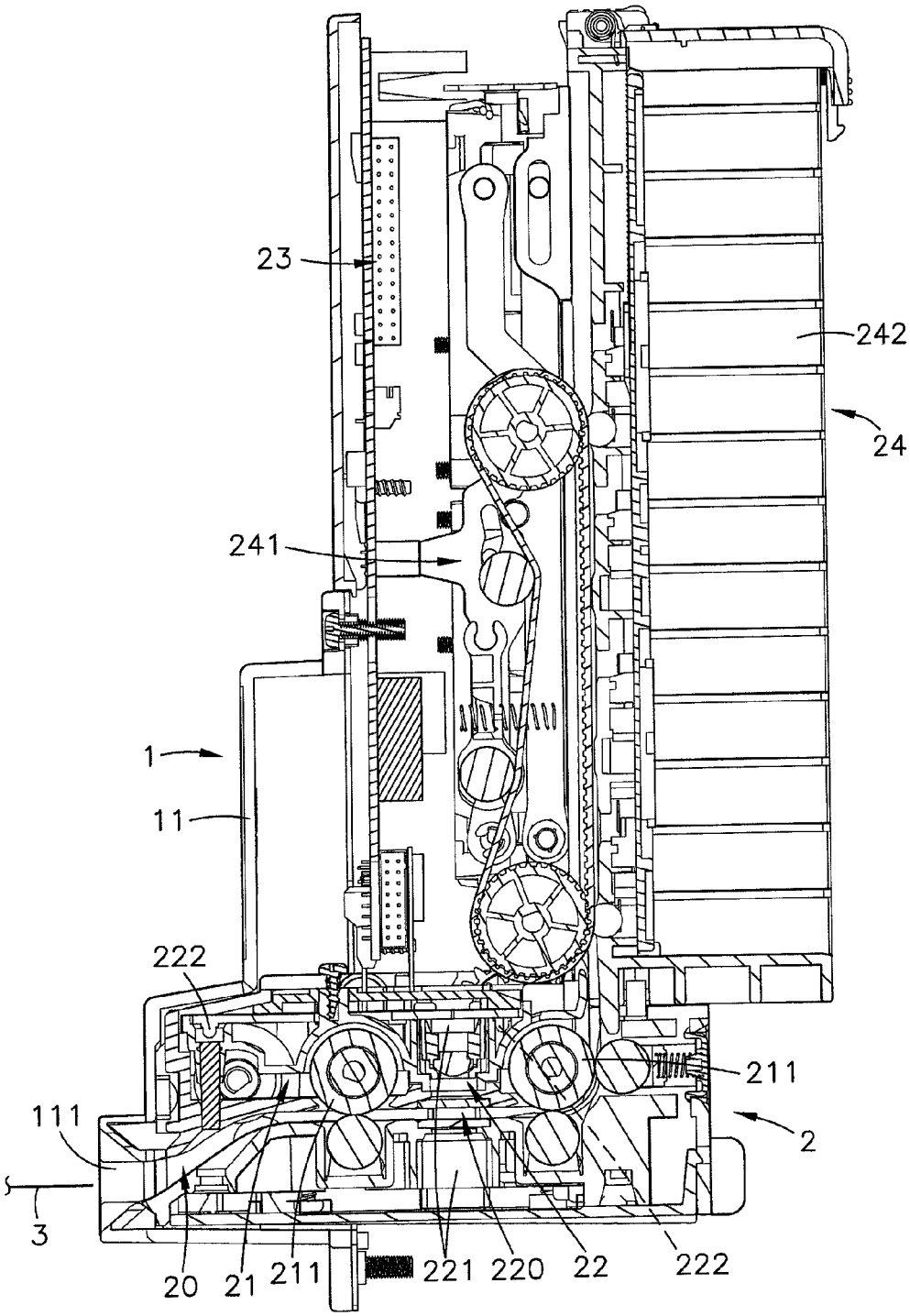
FIG. 5 is a sectional side view of the bill acceptor shown in FIG. 4.
Figure 6:
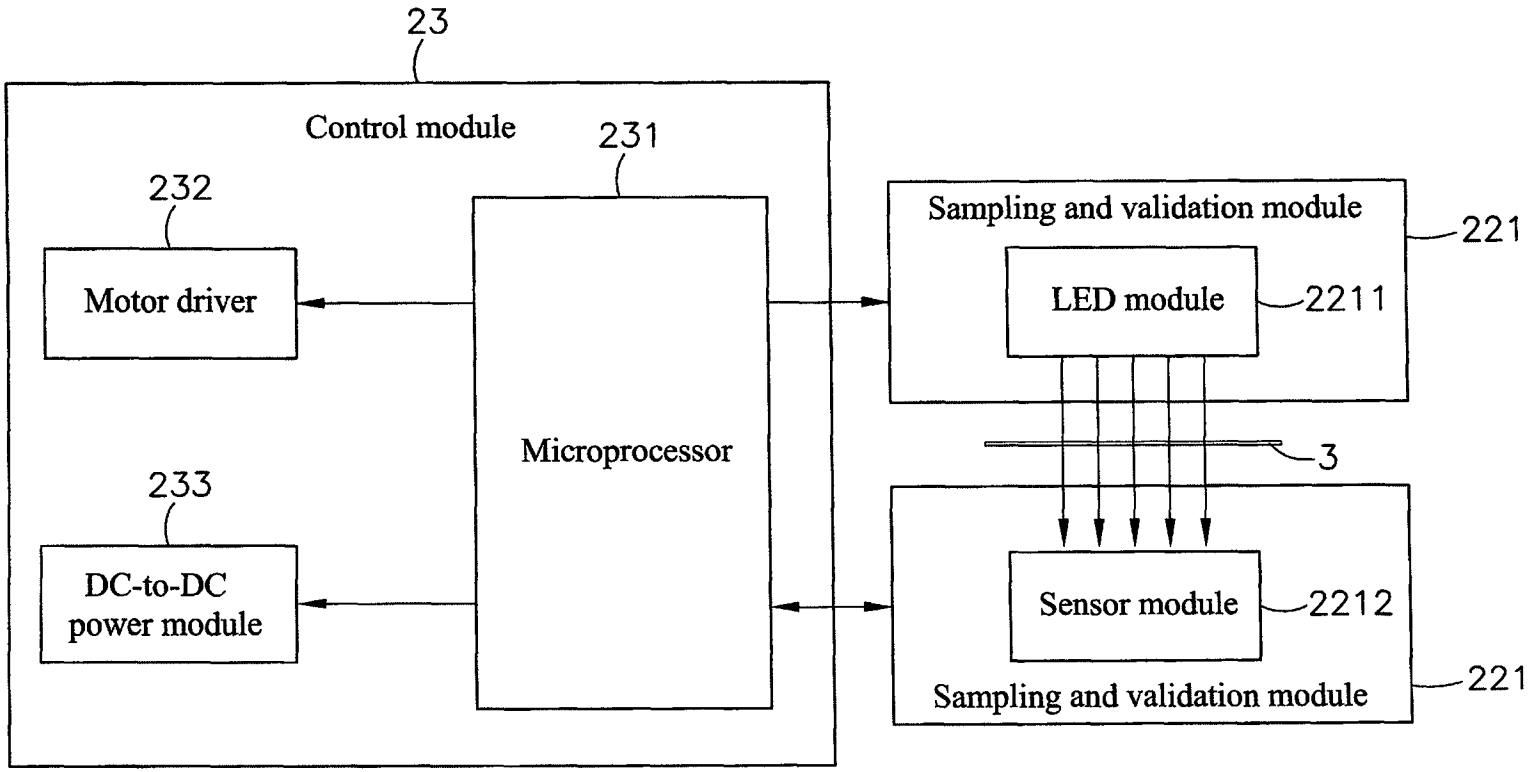
FIG. 6 is a system block diagram of the bill-receiving unit of the bill acceptor in accordance with the present invention.

Referring to FIGS. 1-6, a bill jam troubleshooting in accordance with the present invention is used in a bill acceptor to troubleshoot a bill jam error. The bill acceptor comprises a main unit 1, and a bill-receiving unit 2. The main unit 1 comprises a front face panel 11 defining a bill slot 111. The bill-receiving unit 2 is mounted in the main unit 1, comprising a bill passage 20 in communication with the bill slot 111, a storage device 24 consisting of a bill pressing mechanism 241 and a bill box 242 and disposed at a distal end of the bill passage 20 remote from the bill slot 111, a transmission mechanism 21 adapted for transferring each inserted bill from the bill slot 111 through the bill passage 20 to the storage device 24, a bill validation device 22, and a control module 23 adapted for controlling the bill validation device 22 to validate the authenticity and value of each inserted bill.

The transmission mechanism 21 comprises bill-transfer rollers 211, and a motor (not shown) operable to rotate the bill-transfer rollers 211. The bill validation device 22 comprises a sampling and validation module 221 for validating the authenticity and value of each inserted bill, and a plurality of sensors 222 for detecting the presence of an inserted bill 3 and controlling on/off of the transmission mechanism 21 subject to its detection result. The sampling and validation module 221 comprises a LED module 2211 controllable to emit light, and a sensor module 2212 adapted for receiving light emitted by the LED module 2211. The control module 23 comprises a microprocessor 231 electrically connected to the sampling and validation module 221 and sensors 222 of the bill validation device 22, a motor driver 232 electrically connected to the microprocessor 231 and controllable by the microprocessor 231 to drive the motor and bill-transfer rollers 211 of the transmission mechanism 21, a DC-to-DC power module 233 electrically connected to the microprocessor 231 and adapted to provide the necessary working DC power supply.

The bill acceptor employing the bill jam troubleshooting in accordance with the present invention is to be used in an automatic vending machine, game machine or consumer system configured to provide selling items and/or consumer services. After installation of the bill acceptor in a consumer system, the control module 23 of the bill-receiving unit 2 is electrically connected to the internal circuit of the consumer system through at least one electrical connector at a circuit board thereof for power and data transmission.

The bill acceptor employing the bill jam troubleshooting works subject to the following steps:

(101) Start.

(102) Initialize machine check.

(103) Enter standby mode to wait for insertion of a bill.

(104) Inserted bill 3 induces the sensors 222 to drive the transmission mechanism 21, causing the transmission mechanism 21 to carry the bill 3 to a validation zone 220.

(105) The bill validation device 22 validates the authenticity of the bill 3, and then the system proceeds to step (106) if the bill 3 is a true bill, or step (107) if the bill 3 is a counterfeit bill.

(106) The transmission mechanism 21 presses the bill 3 to start receiving the bill 3.

(107) The transmission mechanism 21 has returned the bill? And then the system returns to step (103) if the bill is returned, or proceeds to step (108) if the bill is not returned.

(108) The transmission mechanism 21 starts troubleshooting to clear the jammed bill.

As stated above, when the main unit of the automatic vending machine, game machine or consumer system is powered on, it initializes all the firmware parameters and checks the functioning of all parts of the system. When checked normal, the system enters the standby mode to wait for the insertion of a bill 3. When a user inserted a bill 3 into the bill slot 110 of the front face panel 11 of the main unit 1 of the bill acceptor, the bill 3 enters the bill passage 20 of the bill-receiving unit 2 to reach the position of the sensors 222 of the bill validation device 22, inducing the sensors 222 of the bill validation device 22 to start the transmission mechanism 21. At this time, the bill-transfer rollers 211 of the transmission mechanism 21 are rotated to carry the bill 3 to a validation zone 220 in the bill passage 20, and the LED module 2211 and sensor module 2212 of the sampling and validation module 221 are controlled by the control module 23 to validate the authenticity and value of the bill 3.

If the matching result made by the sampling and validation module 221 shows that the bill 3 is a true bill, the control module 23 controls the bill-transfer rollers 211 of the transmission mechanism 21 to rotate to carry the bill 3 to the storage device 24, enabling the bill 3 to be put into the bill box 242 by the bill pressing mechanism 241. If the matching result made by the sampling and validation module 221 shows that the bill 3 is a counterfeit bill, the control module 23 controls the bill-transfer rollers 211 of the transmission mechanism 21 to rotate in the reversed direction, carrying the bill 3 back to the bill slot 110 of the front face panel 11, and then the system returns to the standby mode after return of the counterfeit bill. If the bill 3 is jammed during backward delivery, the transmission mechanism 21 will be driven to clear the jammed bill 3.

Figure 7:
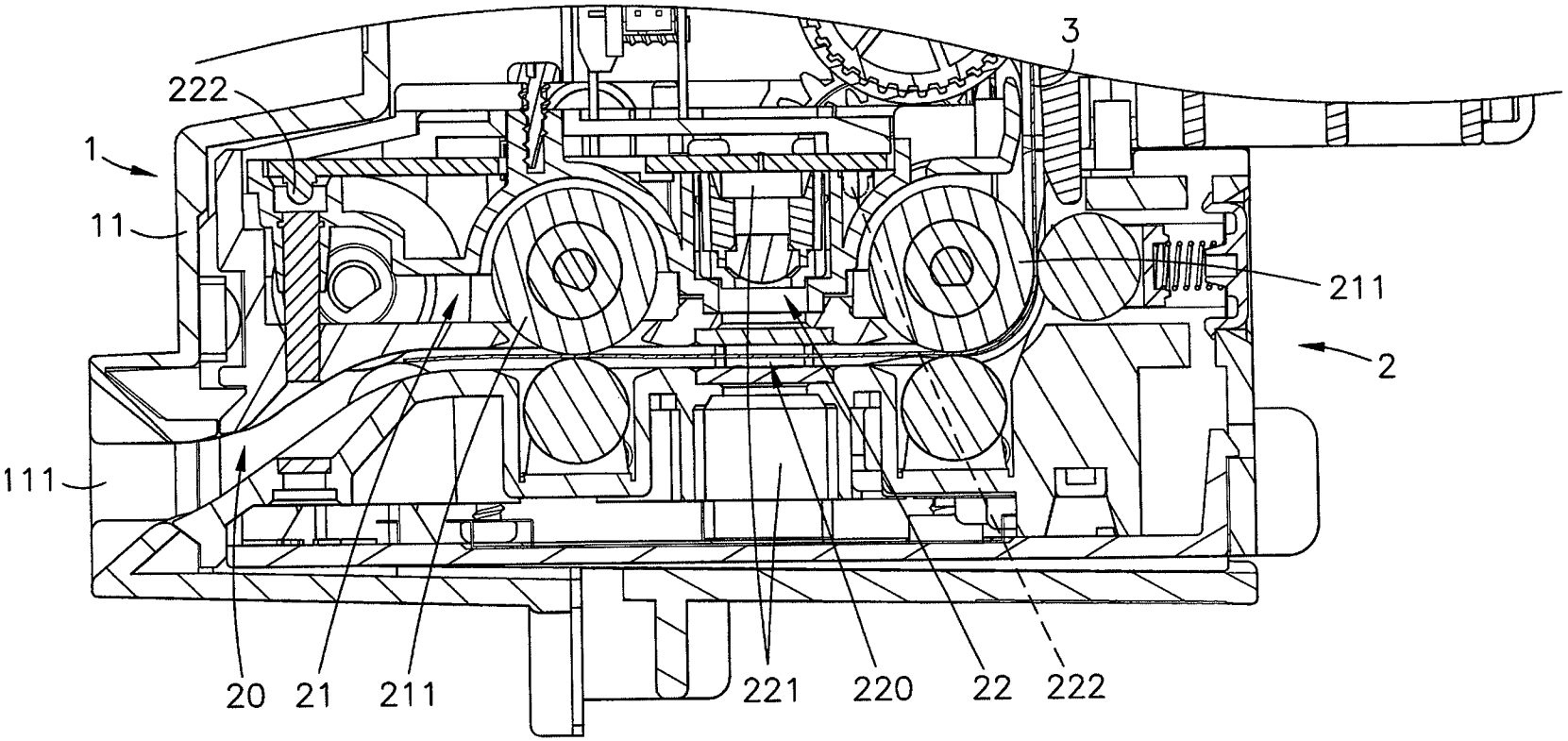
FIG. 7 is a schematic sectional view of a part of the bill acceptor in accordance with the present invention, illustrating the inserted bill delivered to the validation zone.
Figure 8:
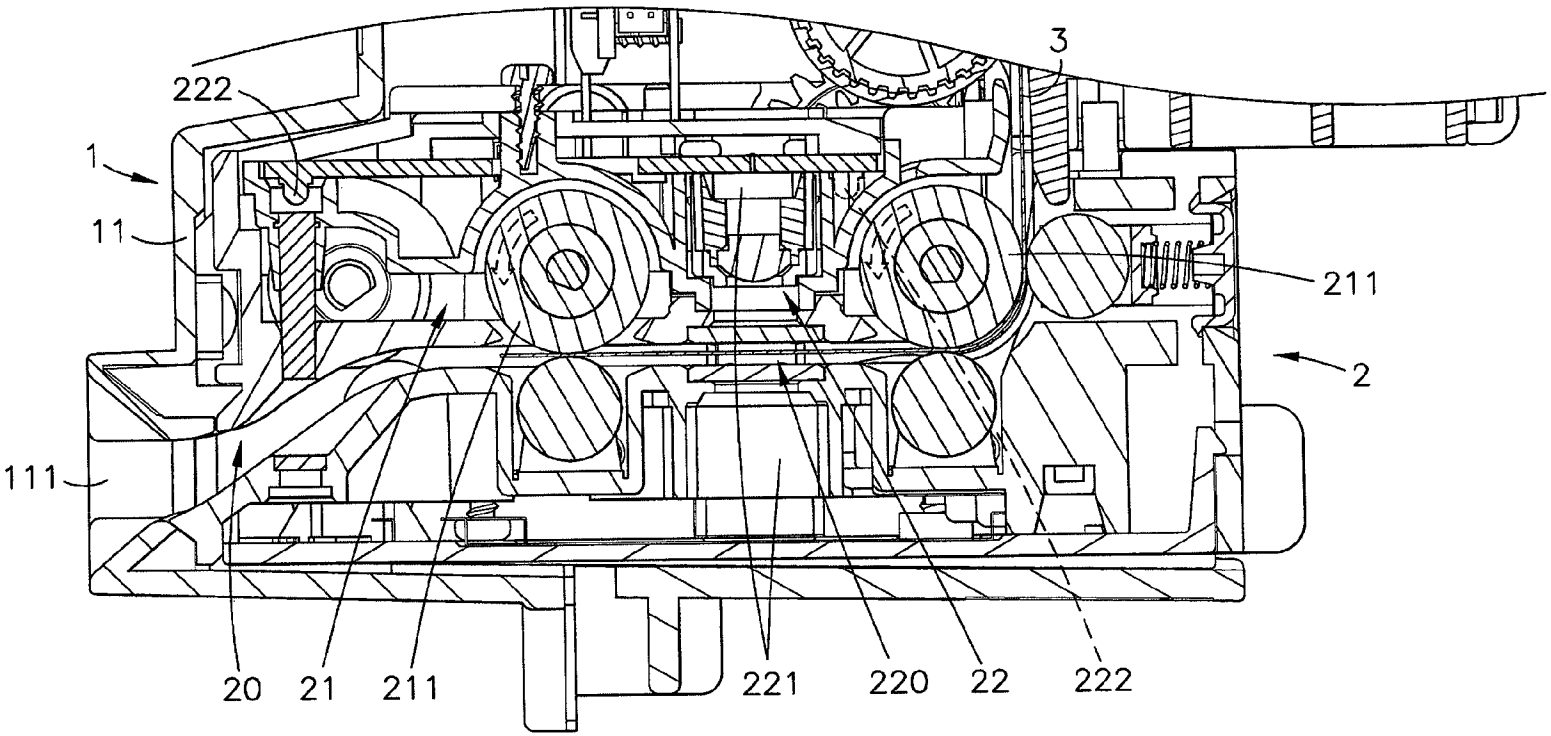
FIG. 8 corresponds to FIG. 7, illustrating the bill moved inwardly over the validation zone.
Figure 9:
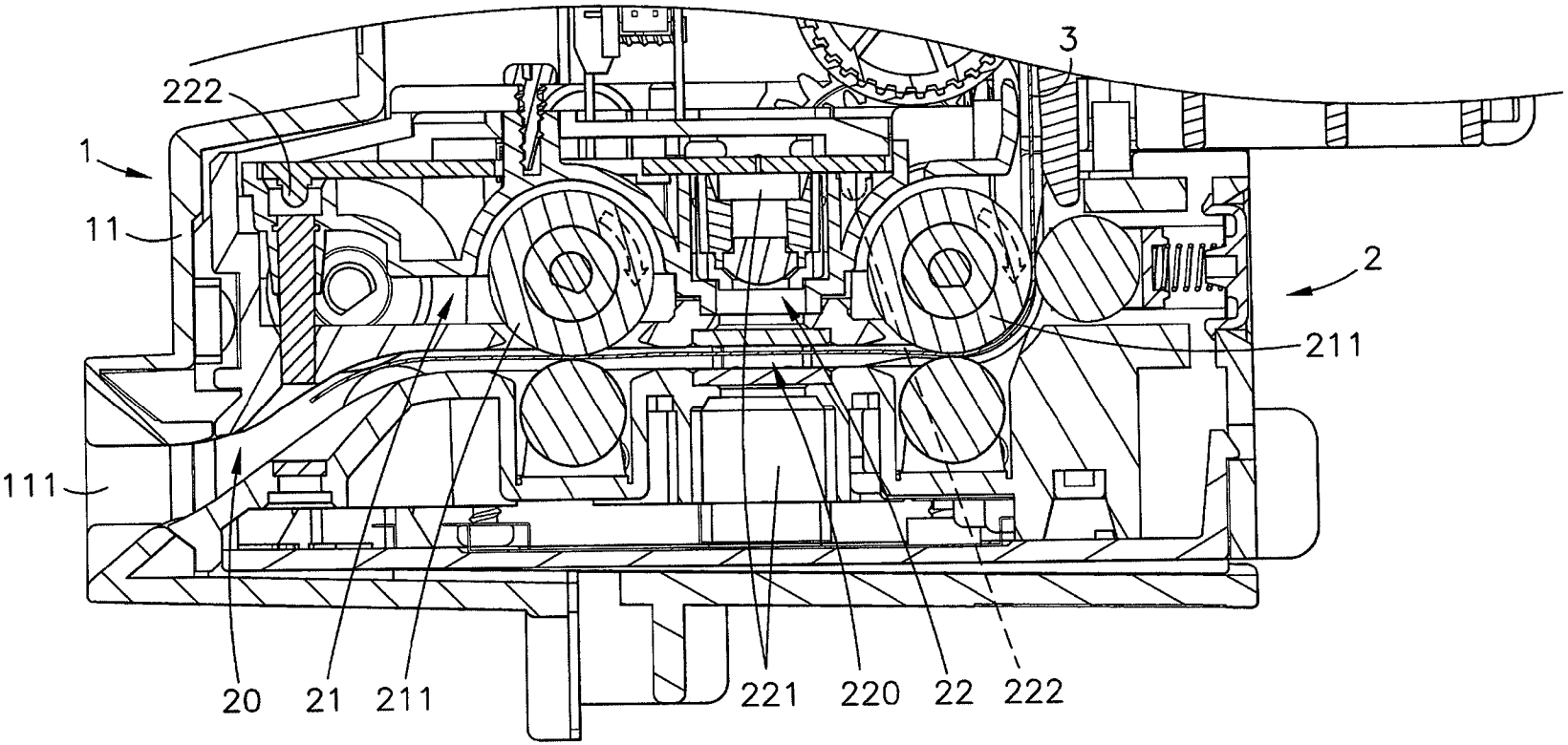
FIG. 9 corresponds to FIG. 7, illustrating the bill moved backwardly toward the bill slot.

Referring to FIGS. 7-9, if the bill 3 is jammed during its backward delivery by the bill-transfer rollers 211 of the transmission mechanism 21, the system starts troubleshooting subject to the following steps:

(201) Start.

(202) Display an error message.

(203) The sensors 222 sense whether or not a bill is jammed in the bill passage 20? And then, the system proceeds to step (204) if a bill is jammed in the bill passage 20, or step (207) if not.

(204) Start the transmission mechanism 21 to carry the bill 3 back and forth over the validation zone 220 repeatedly at least two times.

(205) The transmission mechanism 21 carries the bill 3 outwardly (backwardly to the bill slot) for return.

(206) The sensors 222 sense whether or not a bill is jammed in the bill passage 20? And then, the system returns to step (204) if a bill is jammed in the bill passage 20, or proceeds to step (207) if not.

(207) The transmission mechanism 21 is controlled to return the bill 3 to the bill slot 110.

(208) Troubleshooting is done, and the system returns to the standby mode.

As stated above, when the control module 23 recognized the inserted bill 3 is jammed during its return delivery, the display unit (not shown) displays the error message, and the sensors 222 of the bill validation device 22 are controlled to check any jammed bill in the bill passage 20 of the bill-receiving unit 2. During this checking procedure, the transmission mechanism 21 is controlled to carry the bill 3 back and forth over the validation zone 220, and the sensors 222 sense displacement of the bill 3 over the validation zone 220. The system is pre-set to carry the bill 3 back and forth over the validation zone 220 repeatedly for n times during troubleshooting. After the control module 23 recognized that no bill is jammed in the bill passage 20, the bill-transfer rollers 211 of the transmission mechanism 21 are rotated to carry the bill 3 in the reversed direction toward the bill slot 110 of the front face panel 11 for return, clearing the bill jam problem. Thus, the invention improves the function and effect on the overall use of the product, and enhances the advantages and opportunities of commodity sales channels to increase product competitiveness.

Further, in an alternate form of the present invention, if the bill 3 is jammed during its backward delivery by the bill-transfer rollers 211 of the transmission mechanism 21, the system starts troubleshooting subject to the following steps:

(301) Start.

(302) Display an error message.

(303) The sensors 222 sense whether or not a bill is jammed in the bill passage 20? And then, the system proceeds to step (304) if a bill is jammed in the bill passage 20, or step (309) if not.

(304) Start the transmission mechanism 21 to carry the bill 3 back and forth over the validation zone 220 repeatedly at least two times.

(305) The transmission mechanism 21 carries the bill 3 outwardly (backwardly to the bill slot) for return.

(306) The sensors 222 sense whether or not a bill is jammed in the bill passage 20? And then, the system proceeds to step (307) if a bill is jammed in the bill passage 20, or step (309) if not.

(307) The transmission mechanism 21 is controlled to carry the bill 3 backwardly toward the bill slot 110 twice.

(308) The sensors 222 sense whether or not a bill is jammed in the bill passage 20? And then, the system returns to step (304) if a bill is jammed in the bill passage 20, or proceeds step (309) if not.

(309) The transmission mechanism 21 carries the bill 3 outwardly (backwardly to the bill slot) for return.

(310) Troubleshooting is done, and the system returns to the standby mode.

As stated above, when the bill-receiving unit 2 starts troubleshooting, the display unit lights on a different color of indicator light to indicate an error message, and the sensors 222 of the bill validation device 22 are controlled to check any jammed bill in the bill passage 20 of the bill-receiving unit 2. During this checking procedure, the transmission mechanism 21 is controlled to carry the bill 3 back and forth over the validation zone 220 repeatedly for n times and then to carry the bill 3 outwardly (backwardly toward the bill slot). If the sensors 222 still sense a bill jam in the bill passage 20 at this time, the transmission mechanism 21 will be controlled to carry the bill 3 back and forth over the validation zone 220 repeatedly for another n times and then to carry the bill 3 outwardly (backwardly toward the bill slot) till that the control module 23 makes sure that no bill is jammed in the bill passage 20. At this time, the bill-transfer rollers 211 of the transmission mechanism 21 are rotated to carry the bill 3 in the reversed direction toward the bill slot 110 of the front face panel 11 for return, clearing the bill jam problem.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A method of bill jam troubleshooting employed in a bill acceptor used in a consumer system that provides selling items and/or consumer services to troubleshoot a bill jam error, said bill acceptor comprising, a main unit defining a bill slot in a front face panel thereof, and bill-receiving unit mounted in said main unit, said bill-receiving unit comprising, a bill passage in communication with said bill slot, a storage device comprising a bill pressing mechanism, and a bill box and disposed at a distal end of said bill passage remote from said bill slot, a transmission mechanism adapted for transferring each inserted bill from said bill slot through said bill passage to said storage device, a bill validation device comprising, a sampling and validation module for validating the authenticity and value of each inserted bill, and a plurality of sensors for detecting the presence of an inserted bill in said bill passage and controlling on/off of said transmission mechanism, and a control module adapted for controlling said bill validation device to validate the authenticity and value of each inserted bill and driving said transmission mechanism to operate subject to the validation result of said bill validation device, the method of bill jam troubleshooting performing subject to the following steps:

(a1) starting the bill acceptor;

(a2) initializing a machine check;

(a3) entering a standby mode to wait for insertion of a bill;

(a4) inserted bill inducing said sensors to drive said transmission mechanism, causing said transmission mechanism to carry the bill to a validation zone;

(a5) said bill validation device validating the authenticity of the inserted bill, and then the system proceeding to step (a6) if the inserted bill is a true bill, or step (a7) if the inserted bill is a counterfeit bill;

(a6) said transmission mechanism pressing the inserted bill to start receiving the bill;

(a7) determining whether or not said transmission mechanism has returned the bill, and then the system returning to step (a3) if the bill is returned, or proceeding to step (a8) if the bill is not returned;

(a8) said transmission mechanism starting troubleshooting to clear the jammed bill, wherein when said system starts troubleshooting, the bill jam troubleshooting performs subject to the following steps:

(b1) starting troubleshooting;

(b2) displaying an error message;

(b3) said sensors sensing whether or not a bill is jammed in said bill passage, and then, the system proceeding to step (b4) if a bill is jammed in the bill passage, or step (b7) if not;

(b4) starting said transmission mechanism to carry the inserted bill back and forth over said validation zone repeatedly at least two times;

(b5) said transmission mechanism carrying the inserted bill outwardly for return;

(b6) said sensors sensing whether or not a bill is jammed in said bill passage, and then, the system returning to step (b4) if a bill is jammed in said bill passage, or proceeding to step (b7) if not;

(b7) controlling said transmission mechanism to return the inserted bill to said bill slot;

(b8) finishing troubleshooting, and the system returning to the standby mode.

2. A method of bill jam troubleshooting employed in a bill acceptor used in a consumer system that provides selling items and/or consumer services to troubleshoot a bill jam error, said bill acceptor comprising, a main unit defining a bill slot in a front face panel thereof and bill-receiving unit mounted in said main unit, said bill-receiving unit comprising, a bill passage in communication with said bill slot, a storage device comprising a bill pressing mechanism, and a bill box and disposed at a distal end of said bill passage remote from said bill slot, a transmission mechanism adapted for transferring each inserted bill from said bill slot through said bill passage to said storage device, a bill validation device comprising, a sampling and validation module for validating the authenticity and value of each inserted bill and a plurality of sensors for detecting the presence of an inserted bill in said bill passage and controlling on/off of said transmission mechanism, and a control module adapted for controlling said bill validation device to validate the authenticity and value of each inserted bill and driving said transmission mechanism to operate subject to the validation result of said bill validation device, the method of bill jam troubleshooting performing subject to the following steps:

(a1) starting the bill acceptor;

(a2) initializing a machine check;

(a3) entering a standby mode to wait for insertion of a bill;

(a4) inserted bill inducing said sensors to drive said transmission mechanism, causing said transmission mechanism to carry the bill to a validation zone;

(a5) said bill validation device validating the authenticity of the inserted bill, and then the system proceeding to step (a6) if the inserted bill is a true bill, or step (a7) if the inserted bill is a counterfeit bill;

(a6) said transmission mechanism pressing the inserted bill to start receiving the bill;

(a7) determining whether or not said transmission mechanism has returned the bill, and then the system returning to step (a3) if the bill is returned, or proceeding to step (a8) if the bill is not returned;

(a8) said transmission mechanism starting troubleshooting to clear the jammed bill, wherein when said system starts troubleshooting, the bill jam troubleshooting performs subject to the following steps:

(c1) starting troubleshooting;

(c2) displaying an error message;

(c3) said sensors sensing whether or not a bill is jammed in said bill passage, and then, the system proceeding to step (c4) if a bill is jammed in the bill passage, or step (c9) if not;

(c4) starting said transmission mechanism to carry the inserted bill back and forth over said validation zone repeatedly at least two times;

(c5) said transmission mechanism carrying the inserted bill outwardly for return;

(c6) said sensors sensing whether or not a bill is jammed in said bill passage, and then, the system proceeding to step (c7) if a bill is jammed in said bill passage, or step (c9) if not;

(c7) controlling said transmission mechanism to carry the bill backwardly toward said bill slot at least twice;

(c8) said sensors sensing whether or not a bill is jammed in the bill passage, and then, the system returning to step (c4) if a bill is jammed in said bill passage, or proceeding to step (c9) if not;

(c9) said transmission mechanism carrying the inserted bill backwardly to said bill slot for return;

(c10) finishing troubleshooting, and the system returning to the standby mode.

* * * * *